US011849873B2

(12) United States Patent
Debiasi

(10) Patent No.: US 11,849,873 B2
(45) Date of Patent: Dec. 26, 2023

(54) BENDABLE CLOTHES HANGER ASSEMBLY

(71) Applicant: Yvette Debiasi, Toronto (CA)

(72) Inventor: Yvette Debiasi, Toronto (CA)

( * ) Notice: Subject to any disclaimer, the term of this patent is extended or adjusted under 35 U.S.C. 154(b) by 0 days.

(21) Appl. No.: 17/671,856

(22) Filed: Feb. 15, 2022

(65) Prior Publication Data

US 2023/0255381 A1 Aug. 17, 2023

(51) Int. Cl.
*A47G 25/40* (2006.01)

(52) U.S. Cl.
CPC ..... *A47G 25/4076* (2013.01)

(58) Field of Classification Search
CPC ..... A46G 25/40; A46G 25/4015–4092
See application file for complete search history.

(56) References Cited

U.S. PATENT DOCUMENTS

D184,686 S * 3/1959 Rosene ..... D8/371
3,695,492 A 10/1972 Sheba
3,952,929 A * 4/1976 Horvath ..... A47G 25/622 223/94
4,627,544 A * 12/1986 Scarpa ..... A47F 5/14 403/300
4,717,053 A 1/1988 Wang
4,892,238 A * 1/1990 Pinczowski ..... A47G 25/20 223/94
4,981,242 A 1/1991 Grahm
5,022,570 A * 6/1991 Watford ..... A47G 25/60 223/89
6,065,653 A * 5/2000 Lin ..... A47G 25/44 223/94
6,073,819 A 6/2000 Wing
6,328,186 B1 12/2001 Wing
D464,813 S 10/2002 Lin
8,146,784 B1 * 4/2012 Calanca ..... A47G 25/4061 211/85.3
D707,455 S * 6/2014 Goodman ..... A47G 25/4061 D6/317
9,295,351 B2 3/2016 Schaffer

FOREIGN PATENT DOCUMENTS

JP 2008149100 A * 7/2008
WO WO2015010093 1/2015

* cited by examiner

*Primary Examiner* — Ismael Izaguirre

(57) ABSTRACT

A bendable clothes hanger assembly for supporting a variety of types of clothing includes a clothes hanger that has a hook and a pair of arms each extending away from the hook. Each of the arms is comprised of a bendable material such that each of the arms is bendable into a variety of shapes. In this way the clothes hanger can be shaped to accommodate a variety of types of clothing.

5 Claims, 5 Drawing Sheets

BENDABLE CLOTHES HANGER ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to clothes hanger devices and more particularly pertains to a new clothes hanger device for supporting a variety of types of clothing. The device includes a clothes hanger which has a hook and a pair of arms each extending away from the hook. Each of the arms is comprised of a bendable material such that each of the arms can be formed into a variety of shapes. In this way the arms can be shaped to accommodate a variety of types of clothing.

(2) Description of Related Art Including Information Disclosed Under 37 CFR 1.97 and 1.98

The prior art relates to clothes hanger devices including a clothes hanger device which has a laterally expandable neck and laterally adjustable support. The prior art discloses a foldable clothes hanger device that includes a pair of arms that are pivotally disposed on a hook for folding the arms against the hook. The prior art discloses a variety of clothes hanger devices that each includes a pair of arms each comprising a bendable inner portion and a cushion extending around the inner portion. The prior art discloses a flexible clothes hanger that includes a pair of arms which each comprises a resiliently bendable inner member and a flexible outer member which surrounds the resiliently bendable inner member.

(h) BRIEF SUMMARY OF THE INVENTION

An embodiment of the disclosure meets the needs presented above by generally comprising a clothes hanger that has a hook and a pair of arms each extending away from the hook. Each of the arms is comprised of a bendable material such that each of the arms is bendable into a variety of shapes. In this way the clothes hanger can be shaped to accommodate a variety of types of clothing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
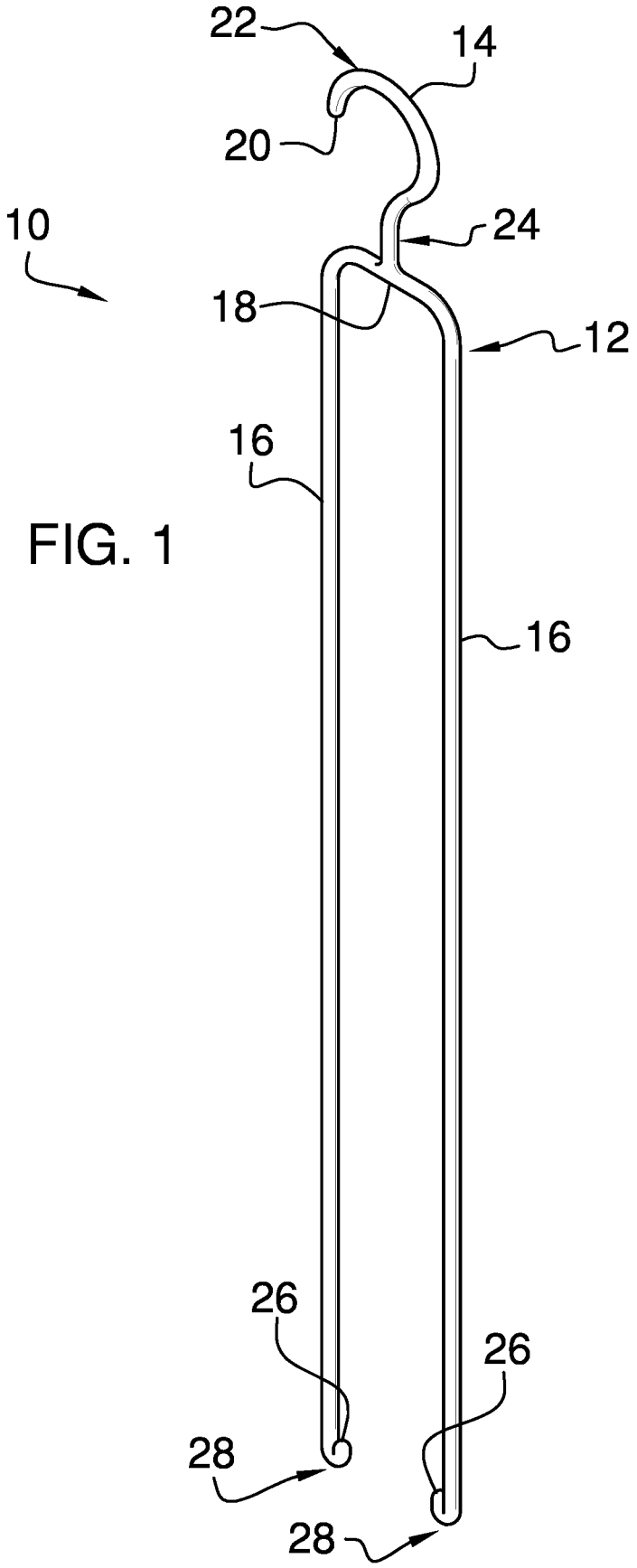
FIG. 1 is a perspective view of a bendable clothes hanger assembly according to an embodiment of the disclosure.
Figure 2:
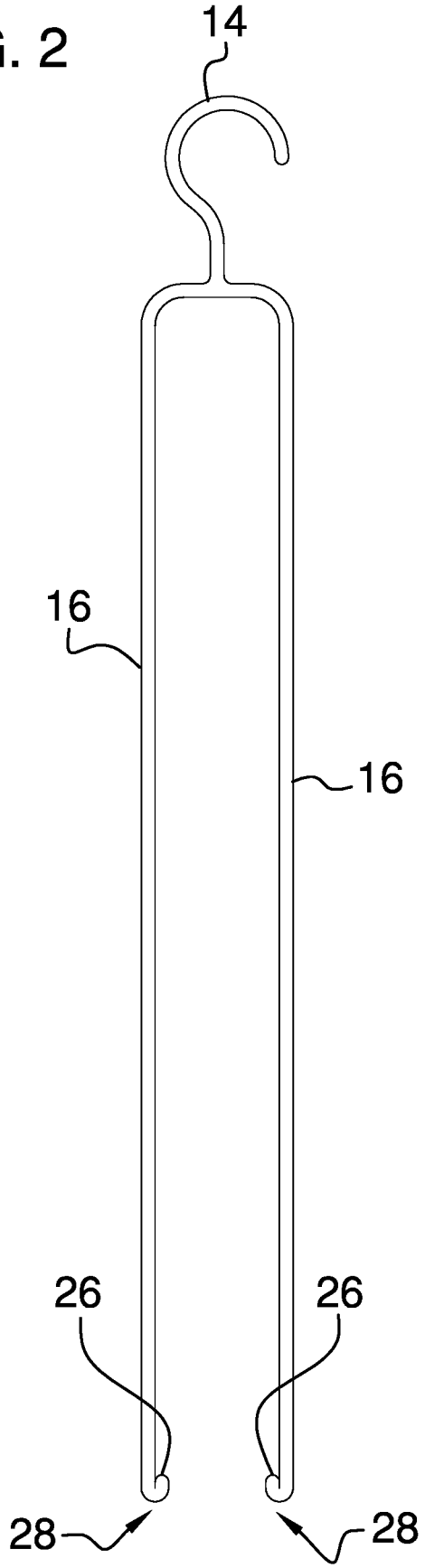
FIG. 2 is a front view of an embodiment of the disclosure.
Figure 3:
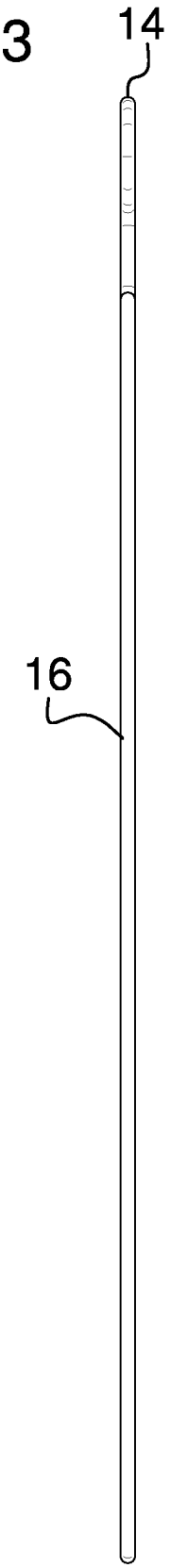
FIG. 3 is a right side view of an embodiment of the disclosure.
Figure 4:
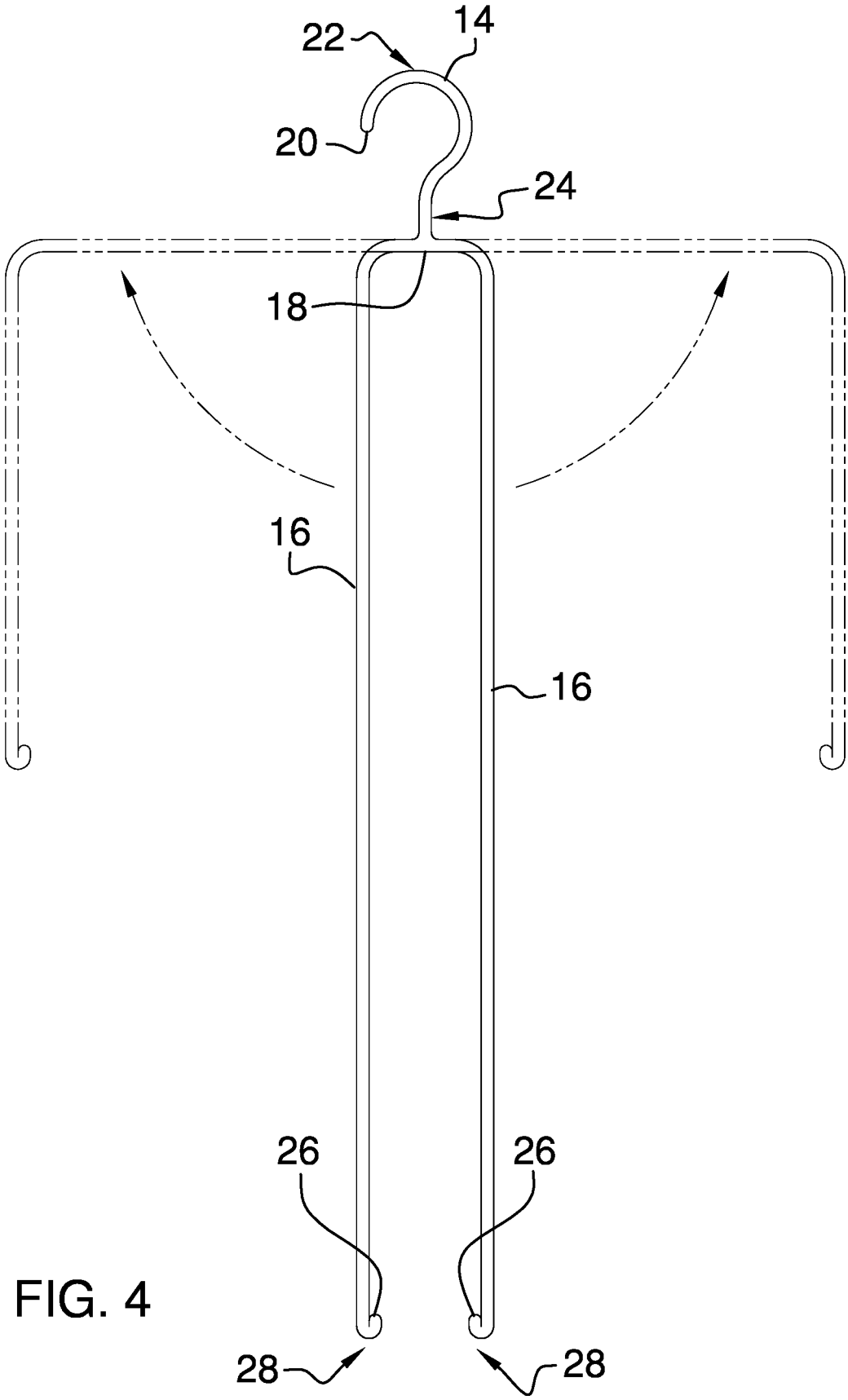
FIG. 4 is a back view of an embodiment of the disclosure showing a pair of arms being bent.

With reference now to the drawings, and in particular to FIGS. 1 through 7 thereof, a new clothes hanger device embodying the principles and concepts of an embodiment of the disclosure and generally designated by the reference numeral 10 will be described.

As best illustrated in FIGS. 1 through 7, the bendable clothes hanger assembly 10 generally comprises a clothes hanger 12 that has a hook 14 and a pair of arms 16 each extending away from the hook 14. Each of the arms 16 is comprised of a bendable material such that each of the arms 16 is bendable into a variety of shapes. In this way the clothes hanger 12 can be shaped to accommodate a variety of types of clothing. The hook 14 has a lower end 18 and an upper end 20, and the hook 14 has a curved portion 22 extending from the upper end 20 toward the lower end 18. Thus, the curved portion 22 defines a circular shape such that the curved portion 22 can be suspended from a closet rod.

The hook 14 has a straightened portion 24 extending between the curved portion 22 and the lower end 18. Each of the arms 16 extends away from the lower end 18 of the hook 14 and each of the arms 16 has a distal end 26 with respect to the lower end 18 of the hook 14. Each of the arms 16 has a bend 28 that is positioned adjacent to the distal end 26 such that the distal end 26 of a respective one of the arms 16 is positioned against the respective arm 16. Furthermore, the bend 28 in each of the arms 16 is permanently formed into the arms 16, and the pair of arms 16 includes a first arm 30 and a second arm 32.

Figure 5:
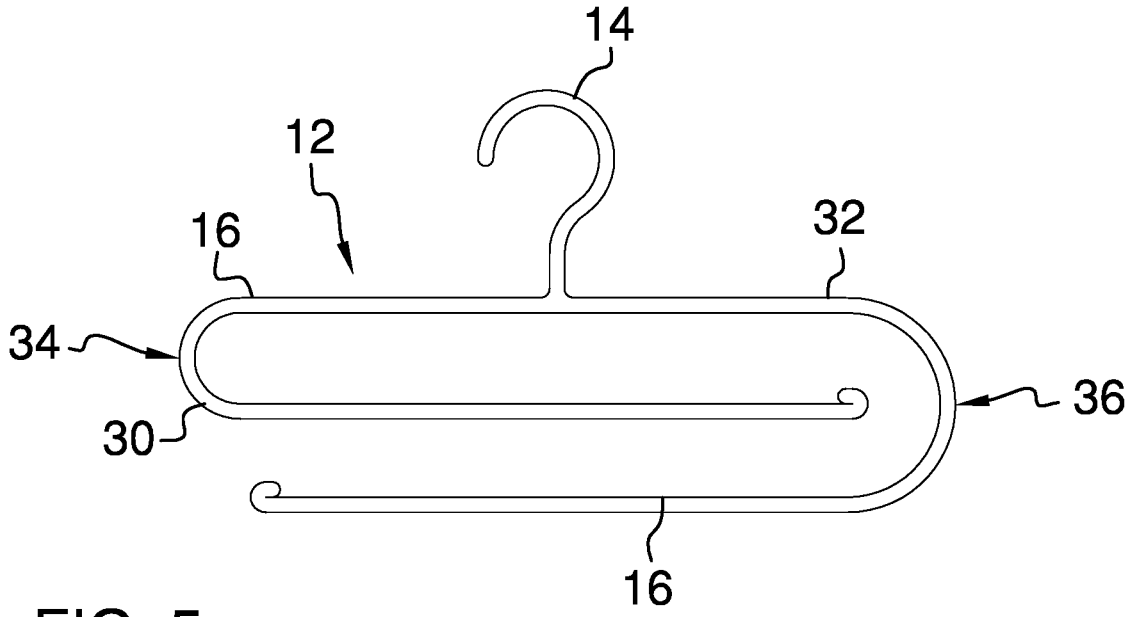
FIG. 5 is a perspective in-use view of an embodiment of the disclosure showing a pair of arms being formed into a pair of loops.
Figure 6:
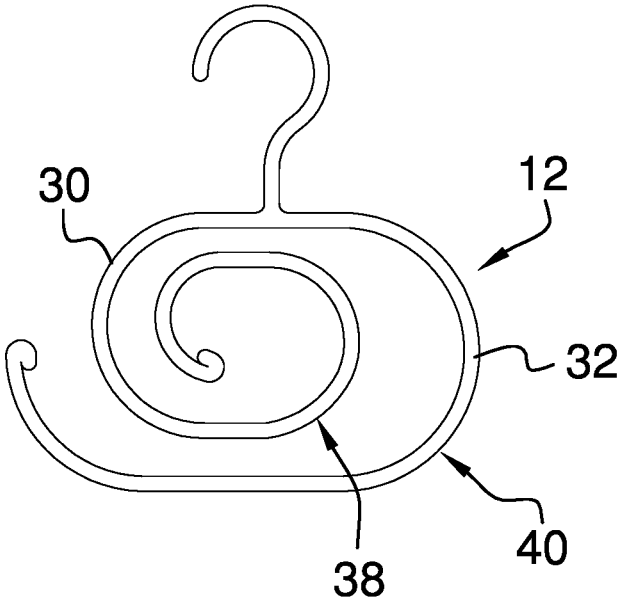
FIG. 6 is a perspective in-use view of an embodiment of the disclosure showing a pair of arms being formed into a respective coil and loop.
Figure 7:
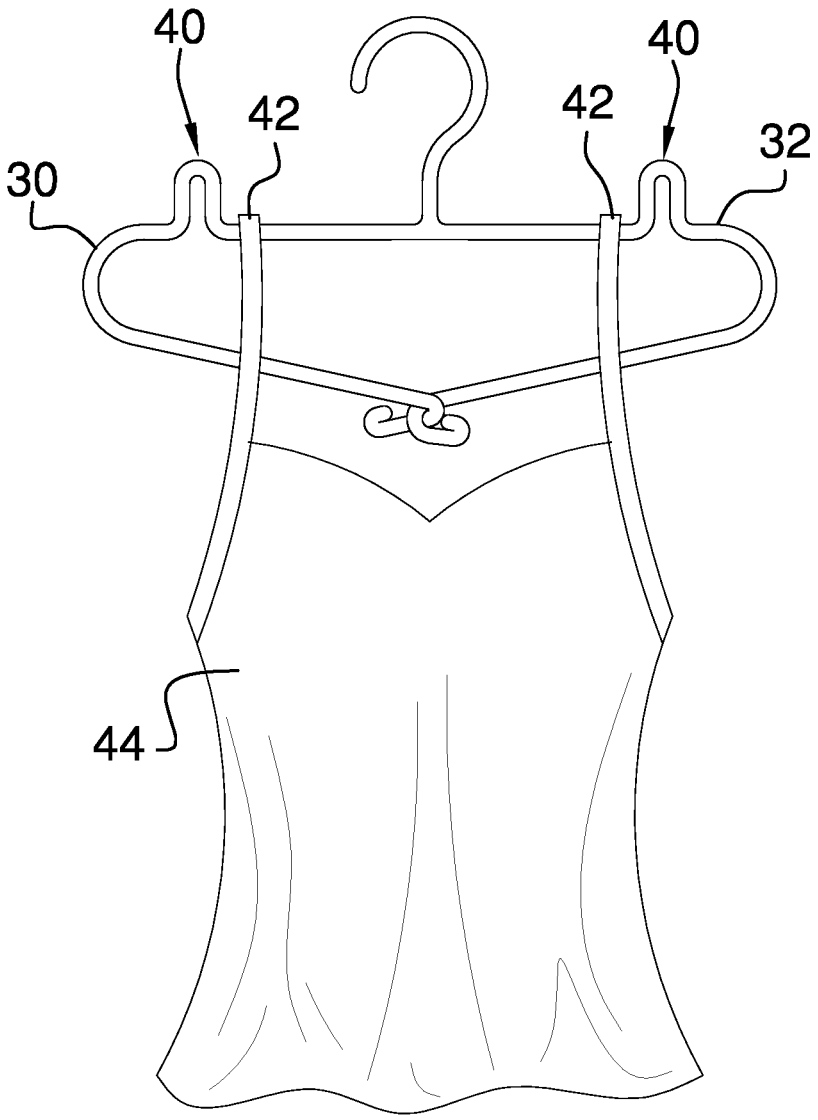
FIG. 7 is a perspective in-use view of an embodiment of the disclosure showing a pair of arms being formed for supporting a dress.

In use, as is most clearly shown in FIG. 5, the second arm 32 can be bent into a loop 34 which extends around a loop 36 formed by the first arm 30. In this way the first arm 30 and the second arm 32 can each support a respective pair of pants. As is most clearly shown in FIG. 6, the first arm 30 can be bent into a coil 38 and the second arm 32 can be bent into a loop 40 that extends around the coil 38 defined by the first arm 30. In this way the first arm 30 can support accessories, such as a waist belt for example, beneath clothing suspended on the second arm 32. As is most clearly shown in FIG. 7, a prominence 40 can be bent into each of the first arm 30 and the second arm 32, located adjacent to the hook 14, and the first arm 30 can be bent around the second arm 32 at a point located adjacent to the distal end 26 of the first arm 30 and second arm 32. In this way the prominence 40 on each of the first arm 30 and the second arm 32 can retain straps 42 of a dress 44 on the clothes hanger 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bendable clothes hanger assembly being bendable into a variety of shapes for accommodating a variety of types of clothing, said assembly comprising:

a clothes hanger having a hook and a pair of arms each extending away from said hook, each of said arms being comprised of a bendable material such that each of said arms is bendable into a variety of shapes wherein said clothes hanger is configured to be shaped to accommodate a variety of types of clothing;

wherein said hook has a lower end and an upper end, said hook having a curved portion extending from said upper end toward said lower end such that said curved portion defines a circular shape wherein said curved portion is configured to be suspended from a closet rod; and each of said arms having a distal end with respect to said lower end of said hook, wherein each of said arms has a bend being positioned adjacent to said distal end such that said distal end of a respective one of said arms is positioned in abutment against said respective arm and a straight folded portion of each arm from the distal end to the bend is in abutment with an unfolded portion of the arm immediately adjacent to the bend.

2. The assembly according to claim 1, wherein said hook has a straightened portion extending between said curved portion and said lower end.

3. The assembly according to claim 1, wherein each of said arms extends away from said lower end of said hook.

4. The assembly according to claim 1, wherein said bend in each of said arms is permanently formed into said arms.

5. A bendable clothes hanger assembly being bendable into a variety of shapes for accommodating a variety of types of clothing, said assembly comprising:

a clothes hanger having a hook and a pair of arms each extending away from said hook, each of said arms being comprised of a bendable material such that each of said arms is bendable into a variety of shapes wherein said clothes hanger is configured to be shaped to accommodate a variety of types of clothing, said hook having a lower end and an upper end, said hook having a curved portion extending from said upper end toward said lower end such that said curved portion defines a circular shape wherein said curved portion is configured to be suspended from a closet rod, said hook having a straightened portion extending between said curved portion and said tower end, each of said arms extending away from said lower end of said hook, each of said arms having a distal end with respect to said lower end of said hook, each of said arms having a bend being positioned adjacent to said distal end such that said distal end of a respective one of said arms is positioned in abutment against said respective arm and a straight folded portion of each arm from the distal end to the bend is in abutment with an unfolded portion of the arm immediately adjacent to the bend, said bend in each of said arms being permanently formed into said arms.

* * * * *